US009755303B2

(12) United States Patent
Ko et al.

(10) Patent No.: US 9,755,303 B2
(45) Date of Patent: Sep. 5, 2017

(54) ANTENNA STRUCTURE AND WIRELESS COMMUNICATION DEVICE USING SAME

(71) Applicant: FIH (HONG KONG) LIMITED, Kowloon (HK)

(72) Inventors: Cheng-Hung Ko, New Taipei (TW); Chuan-Chou Chi, New Taipei (TW); Hao-Ying Chang, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 140 days.

(21) Appl. No.: 14/682,869

(22) Filed: Apr. 9, 2015

(65) Prior Publication Data

US 2016/0190688 A1 Jun. 30, 2016

(30) Foreign Application Priority Data

Dec. 31, 2014 (TW) ..... 103146690 A

(51) Int. Cl.

| | |
|---|---|
| ***H01Q 1/38*** | (2006.01) |
| ***H01Q 1/24*** | (2006.01) |
| ***H01Q 1/52*** | (2006.01) |

(52) U.S. Cl.
CPC ..... *H01Q 1/38* (2013.01); *H01Q 1/243* (2013.01); *H01Q 1/52* (2013.01)

(58) Field of Classification Search
USPC ..... 343/700 MS, 702, 843
See application file for complete search history.

(56) References Cited

U.S. PATENT DOCUMENTS

2012/0249393 A1* 10/2012 Hotta ..... H01Q 1/243 343/843

* cited by examiner

*Primary Examiner* — Hoang Nguyen
*Assistant Examiner* — Hai Tran
(74) *Attorney, Agent, or Firm* — Steven Reiss

(57) ABSTRACT

An antenna structure includes a feed unit, a grounding unit, a connecting unit, a radiating unit, and a resonating unit. The grounding unit is spaced apart from the feed unit. The connecting unit resists and is electrically connected to the feed unit and the grounding unit. The radiating unit is electrically connected to one side of the connecting unit so as to activate a first resonance mode. The resonating unit is electrically connected to another side of the connecting unit so as to activate a second resonance mode.

17 Claims, 5 Drawing Sheets

ANTENNA STRUCTURE AND WIRELESS COMMUNICATION DEVICE USING SAME

FIELD

The subject matter herein generally relates to an antenna structure and a wireless communication device using the antenna structure.

BACKGROUND

A wireless communication device uses an antenna to transmit and receive wireless signals at different frequencies for different communication systems. The structure of the antenna assembly is complicated and occupies a large space in the wireless communication device, which is inconvenient for minimization of the wireless communication device. In addition, some other metal electronic elements, such as universal serial bus (USB), battery, electromagnetic shielding, and display, may affect the transmission of the antenna.

BRIEF DESCRIPTION OF THE DRAWINGS

Implementations of the present technology will now be described, by way of example only, with reference to the attached figures.

DETAILED DESCRIPTION

Figure 1:
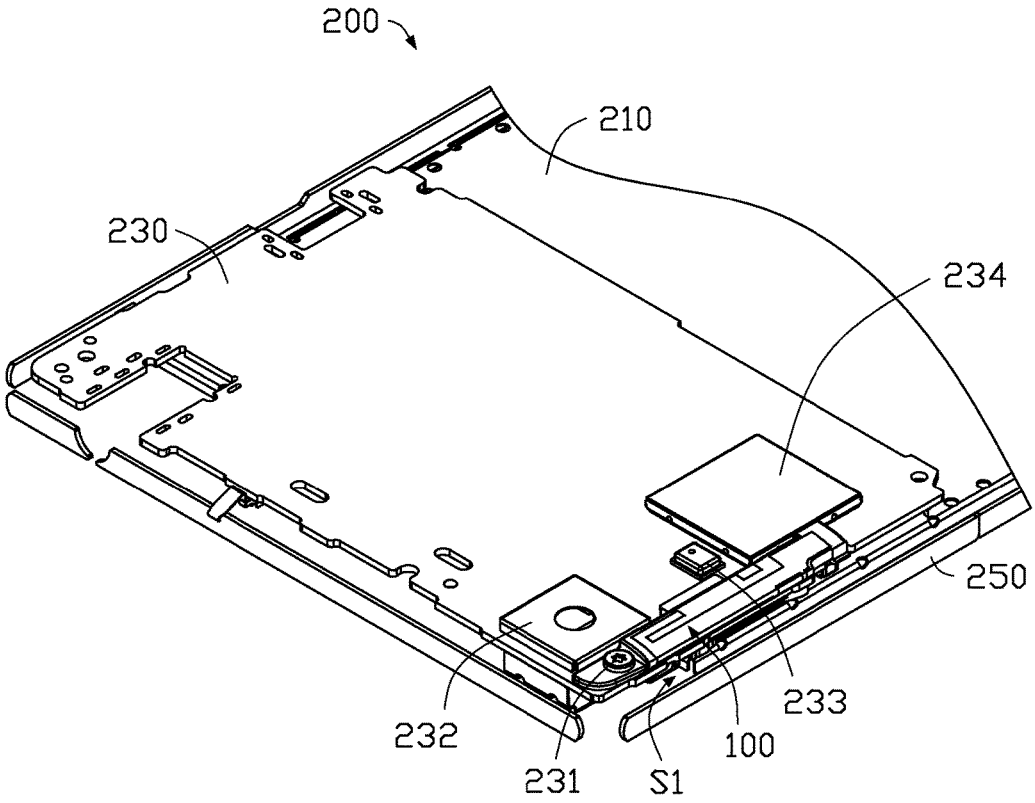
FIG. 1 is an assembled, isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 200. The wireless communication device 200 can be a mobile phone or a personal digital assistant, for example. The wireless communication device 200 includes a grounding plane 210, a baseboard 230, a metallic portion 250, and an antenna structure 100.

In this embodiment, the grounding plane 210 can be a metallic frame of the wireless communication device 200 and the baseboard 230 can be a printed circuit board. The baseboard 230 is positioned on and is electrically connected to the grounding plane 210 for being grounded. The metallic portion 250 can be a portion of a housing of the wireless communication device 200. In this embodiment, the metallic portion 250 is substantially rectangular and is positioned surround the grounding plane 210. The metallic portion 250 is also electrically connected to the grounding plane 210 for reducing an effect of the metallic portion 250 on a radiating performance of the antenna structure 100.

The wireless communication device 200 further includes a plurality of electronic elements. In this embodiment, the wireless communication device 200 includes at least a first element 231, a second element 232, a third element 233, and a fourth element 234. The first element 231, the second element 232, the third element 233, the fourth element 234, and the antenna structure 100 are positioned at a first surface of the baseboard 230 and are all positioned adjacent to one side of the metallic portion 250.

Figure 2:
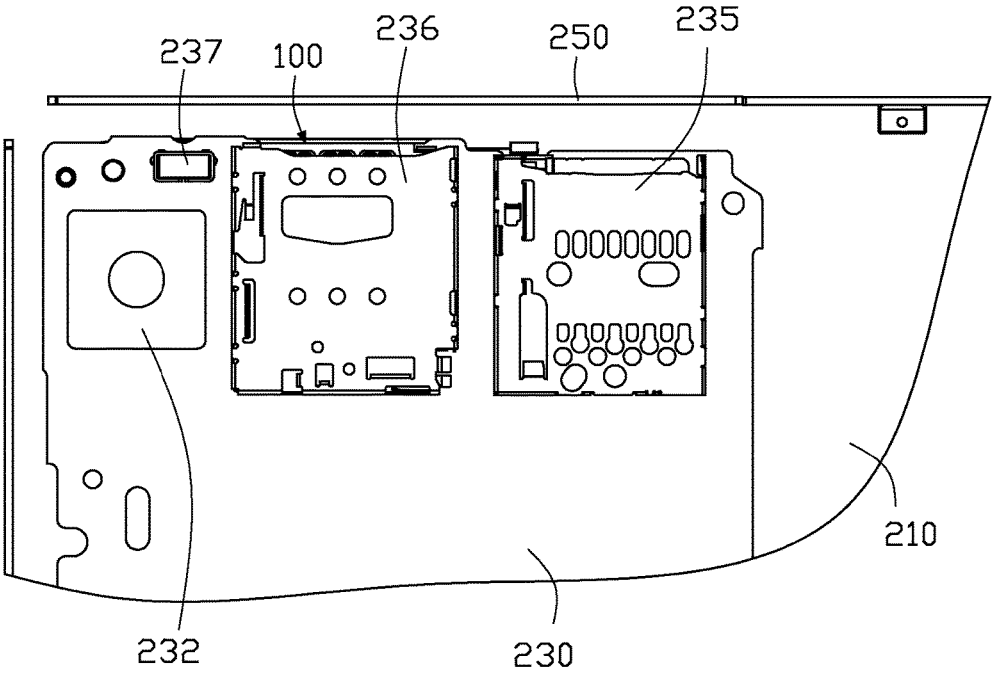
FIG. 2 is similar to FIG. 1, but shown in another angle.

Referring to FIG. 2, the wireless communication device 200 further includes a fifth element 235, a sixth element 236, and a seventh element 237. The fifth element 235, the sixth element 236, and the seventh element 237 are positioned at a second surface of the baseboard 230 opposite to the first surface. In this embodiment, the first to seventh elements 231-237 are all metallic elements. In detail, the first element 231 is a screw for fixing the antenna structure 100. The second element 232 is a camera. The third element 233 is a microphone. The fourth element 234 is a shielding can. The fifth element 235 is storing cassette. The sixth element 236 is a SIM cassette. The seventh element 237 is a side button.

In other embodiments, a metallic isolating layer (not shown) can be positioned on the first surface of the baseboard 230 for preventing the fifth element 235, the sixth element 236, and the seventh element 237 from affecting a radiation of the antenna structure 100.

Figure 3:
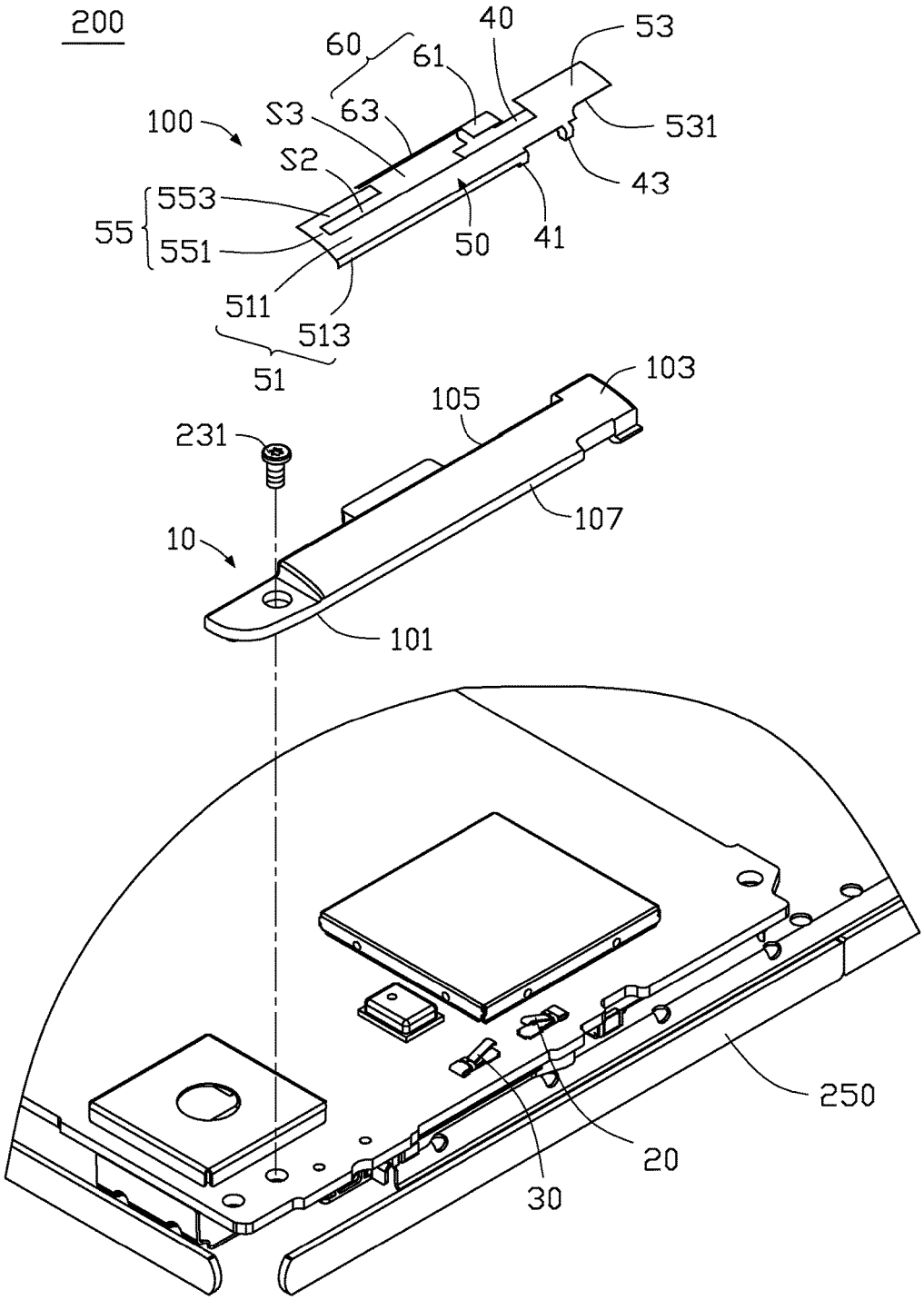
FIG. 3 is an exploded, isometric view of the wireless communication device of FIG. 1.

FIG. 3 illustrates that the antenna structure 100 includes an antenna holder 10, a feed unit 20, a grounding unit 30, a connecting unit 40, a radiating unit 50, and a resonating unit 60. The antenna holder 10 can be made of non-conductive material, such as plastic. The antenna holder 10 is secured to the first surface of the baseboard 230 and is parallel to one side of the metallic portion 250. The antenna holder 10 includes a bottom surface 101, a top surface 103, a first side surface 105, and a second side surface 107. The bottom surface 101 is positioned facing the baseboard 230. The top surface 103 is positioned opposite to the bottom surface 101. The first side surface 105 and the second side surface 107 are parallel to each other and are perpendicularly connected between the bottom surface 101 and the top surface 103.

The feed unit 20 and the grounding unit 30 are positioned on the first surface of the baseboard 230 and are spaced apart from each other. One end of the feed unit 20 is electrically connected to a radio frequency circuit (not shown) of the wireless communication device 200. The other end of the feed unit 20 is electrically connected to the connecting unit 40 for feeding current to the antenna structure 100. One end of the grounding unit 30 is grounded by the baseboard 230 and the other end of the grounding unit 30 is also electrically connected to the connecting unit 40.

In this embodiment, the connecting unit 40, the radiating unit 50, and the resonating unit 60 are located on surfaces of the antenna holder 10 via a means of laser direct structuring (LDS). The connecting unit 40 is substantially a rectangular sheet and is positioned on the bottom surface 101. The connecting unit 40 is configured to resist the feed unit 20 and the grounding unit 30 so as to obtain current from the feed unit 20 and be grounded via the grounding unit 30. A first connecting section 41 and a second connecting section 43 are formed on the second side surface 107. The first connecting section 41 and the second connecting section 43 are positioned spaced apart from and parallel to each other, and are electrically connected between the connecting unit 40 and the radiating unit 50.

In this embodiment, the radiating unit 50 is configured to activate a first resonance mode having a frequency of about 2.4 GHz. The radiating unit 50 is positioned on the top surface 103 and the second side surface 107. The radiating unit 50 includes a first radiating portion 51, a second radiating portion 53, and a third radiating portion 55. The first radiating portion 51 includes a radiating sheet 511 and an extending sheet 513. The radiating sheet 511 is substantially rectangular. The radiating sheet 511 is positioned on the top surface 103 of the antenna holder 10 and is parallel to one side of the metallic portion 250. The extending sheet 513 is substantially a strip. The extending sheet 513 is positioned on the second side surface 107 and is angled relative to the radiating sheet 511. One end of the extending sheet 513 is collinear with one end of the radiating sheet 511 away from the feed unit 20. The other end of the extending sheet 513 is collinear with and is electrically connected to the first connecting section 41 adjacent to the top surface 103. A space S1 (shown in FIG. 1) is formed between the extending sheet 513 and the metallic portion 250. Via adjusting a width of the space S1, an effect of the metallic portion 250 on the antenna structure 100 can be reduced.

The second radiating portion 53 is substantially rectangular. The second radiating portion 53 is positioned on the top surface 103 and is coupled to one end of the radiating sheet 511 adjacent to the feed unit 20. In this embodiment, a width of the second radiating portion 53 is greater than a width of the radiating sheet 511. An opening 531 is defined at one side of the second radiating portion 53 away from the radiating sheet 511. In this embodiment, the opening 531 is substantially L-shaped.

The third radiating portion 55 is substantially L-shaped and is coplanar with the radiating sheet 511. The third radiating portion 55 includes a first radiating section 551 and a second radiating section 553. The first radiating section 551 is substantially perpendicularly connected to one end of the radiating sheet 511 away from the second radiating portion 53. The second radiating section 553 is perpendicularly connected to one end of the first radiating section 551 away from the radiating sheet 511 and extends towards the second radiating portion 53. Then, a first slot S2 is formed between the second radiating section 553 and the radiating sheet 511. Via adjusting a width of the first slot S2, an effect of the first to fourth elements 231-234 on the antenna structure 100 can be reduced.

Figure 4:
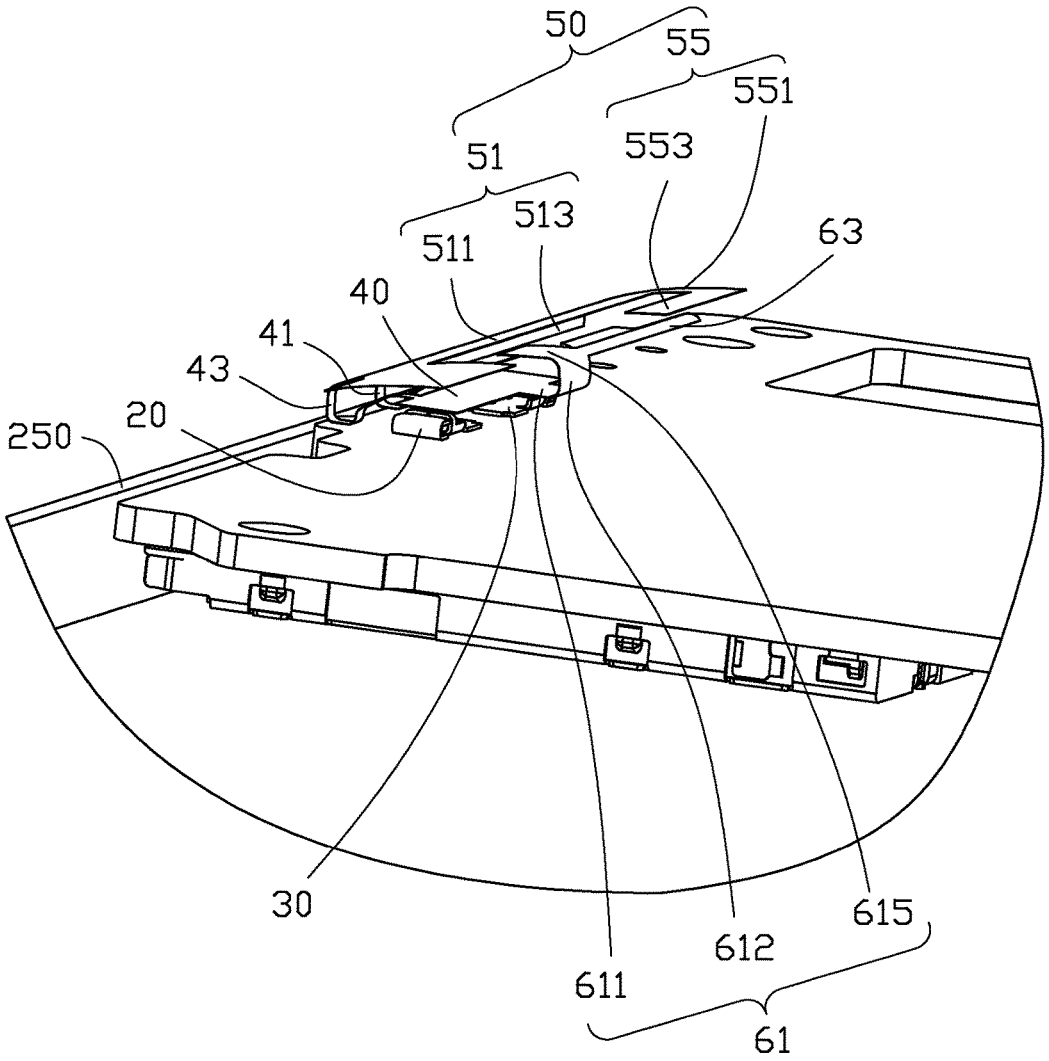
FIG. 4 is a partial, isometric view of the wireless communication device of FIG. 1, but shown in another angle.

Referring to FIG. 4, the resonating unit 60 includes a coupling portion 61 and a resonating portion 63. The coupling portion 61 is substantially U-shaped and includes a first coupling section 611, a second coupling section 613, and a third section 615. In detail, the first coupling section 611 is positioned on the bottom surface 101. The first coupling section 611 is substantially rectangular and is electrically connected to one end of the connecting unit 40 away from the first connecting section 41 and the second connecting section 43. The second coupling section 613 is positioned on the first side surface 105 and is perpendicularly connected between the first coupling section 611 and the third radiating section 615. The third radiating section 615 is substantially rectangular and is positioned on the top surface 103. The third radiating section 615 is electrically connected to one end of the second radiating section 613 away from the first coupling section 611 and extends towards the radiating sheet 511.

The resonating portion 63 is substantially a strip and is positioned on the first side surface 105. The resonating portion 63 is perpendicularly connected to a junction of the second coupling section 613 and the third radiating section 615 and extends towards the second radiating section 553 until a distal end of the resonating portion 63 exceeds a distal end of the second radiating section 553. A second slot S3 is formed between the resonating portion 63 and the radiating sheet 511. In this embodiment, the resonating unit 60 is configured to activate a second resonance mode with a frequency of about 5 GHz. The second resonance mode can further have a frequency band of about 5.150 GHz-5.85 GHz by adjusting a width of the second slot S3.

When current is input to the connecting unit 40 from the feed unit 20, the current flows to the first connecting section 41, the second section 43, and the radiating unit 50, thereby activating the first resonance mode having a frequency of about 2.4 GHz. The current further flows to the resonating portion 63 via the coupling portion 61 so as to activate the second frequency mode having a frequency of about 5 GHz. In addition, the current of the connecting unit 40 flows to the baseboard 230 through the grounding unit 30 to be grounded. Due to the baseboard 230 is electronically connected to the metallic plane 210 and the metallic portion 250, which cooperatively form a ground system of the antenna structure 100, thereby reducing an effect of the metallic plane 210 and the metallic portion 250 on the antenna structure 100.

Figure 5:
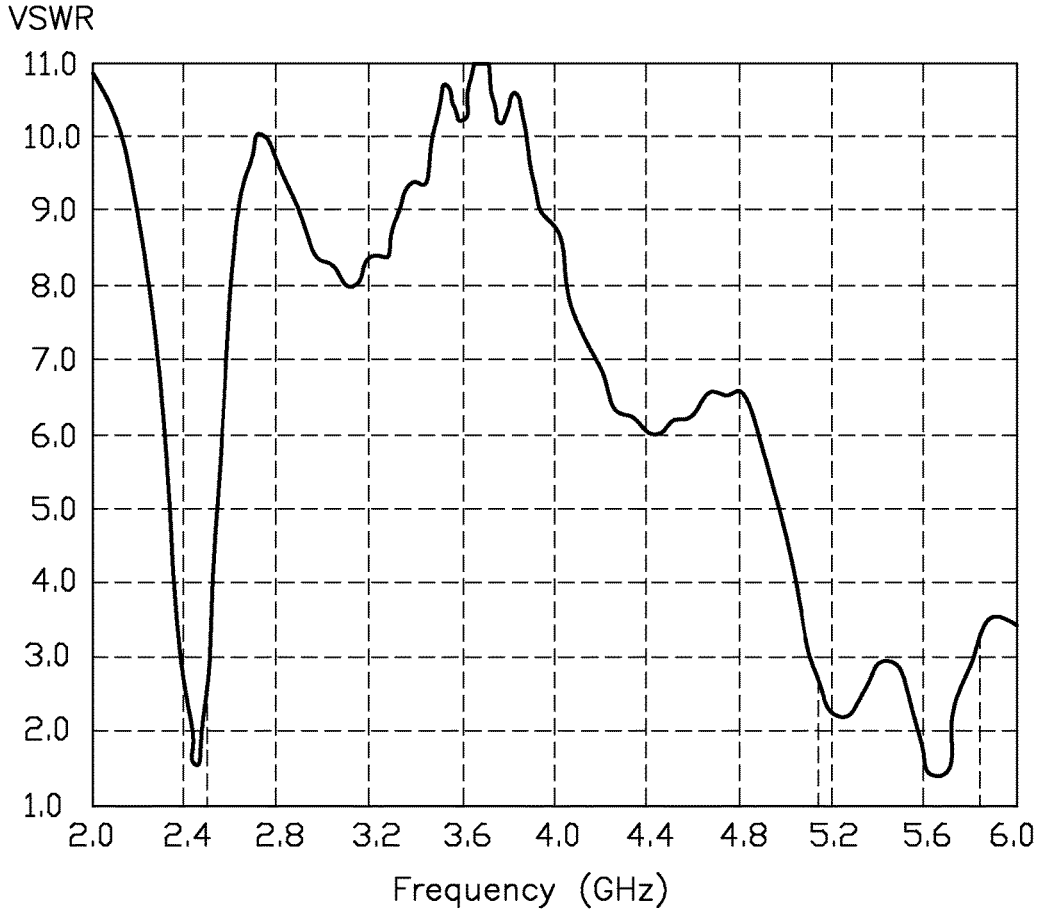
FIG. 5 is a voltage standing wave ratio (VSWR) graph of the antenna structure of the wireless communication device of FIG. 1.

FIG. 5 illustrates a voltage standing wave ratio (VSWR) measurement of the antenna structure 100. Table 1 shows a VSWR of the antenna structure 100 at frequencies of about 2.4 GHz, 2.5 GHz, 5.15 GHz, and 5.85 GHz. Clearly, it can be derived from FIG. 5 and table 1 that the antenna structure 100 and the wireless communication device 200 employing the antenna structure 100 can be utilized in common wireless communication systems and satisfy radiation requirements.

TABLE 1

VSWR of the antenna structure at different frequencies

| Frequency | 2.4 GHz | 2.5 GHz | 5.15 GHz | 5.85 GHz |
|---|---|---|---|---|
| VSWR | 2.9246 | 2.8539 | 2.6839 | 3.2345 |

It can be understood that by adjusting structures and coupling relationship among the connecting unit 40, the radiating unit 50, and the resonating unit 60, the wireless communication device 200 employing the antenna structure 100 can be further utilized in other common wireless communication systems, such as receiving/sending wireless signals at frequency bands of about 700-960 MHz or 1710-2690 MHz, with exceptional communication quality.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feed unit;

a grounding unit spaced apart from the feed unit;

an antenna holder, the antenna holder comprising a bottom surface, a top surface, a first side surface, and a second side surface, wherein the top surface is positioned opposite to the bottom surface; the first side surface and the second side surface are parallel to each other and are perpendicularly connected between the bottom surface and the top surface;

a connecting unit electrically coupled to the feed unit and the grounding unit;

a radiating unit electrically coupled to a first side of the connecting unit and configured to activate a first resonance mode;

a resonating unit electrically coupled to a second side of the connecting unit and configured to activate a second resonance mode;

a first connecting section; and a second connecting section;

wherein the first connecting section and the second connecting section are positioned on the second side surface and the radiating unit is electrically connected to the connecting unit through the first connecting section and the second connecting section.

2. The antenna structure of claim 1, wherein the connecting unit, the radiating unit, and the resonating unit are positioned on surfaces of the antenna holder via a means of laser direct structuring (LDS).

3. The antenna structure of claim 1, wherein the connecting unit is positioned on the bottom surface, the radiating unit is positioned on the top surface and the second side surface, and the resonating unit is positioned on the bottom surface, the top surface, and the first side surface.

4. The antenna structure of claim 1, wherein the radiating unit comprises a first radiating portion; the first radiating portion comprising a radiating sheet and an extending sheet, the radiating sheet is positioned on the top surface and is electrically connected to the first connecting section and the second connecting section; the extending sheet is positioned on the second side surface and is angled relative to the radiating sheet.

5. The antenna structure of claim 4, wherein the radiating unit further comprises a second radiating portion, the second radiating portion is positioned on the top surface and is coupled to one end of the radiating sheet adjacent to the feed unit, and an opening is defined at one side of the second radiating portion away from the radiating sheet.

6. The antenna structure of claim 5, wherein the radiating unit further comprises a third radiating portion, the third radiating portion is coplanar with the radiating sheet and comprises a first radiating section and a second radiating section, the first radiating section is substantially perpendicularly connected to one end of the radiating sheet away from the second radiating portion; the second radiating section is perpendicularly connected to one end of the first radiating section away from the radiating sheet and extends towards the second radiating portion.

7. The antenna structure of claim 1, wherein the resonating unit comprises a coupling portion, the coupling portion is substantially U-shaped and comprises a first coupling section, a second coupling section, and a third section; the first coupling section is positioned on the bottom surface, the second coupling section is positioned on the first side surface, and the third radiating section is positioned on the top surface; the first coupling section is electrically connected to one end of the connecting unit away from the first connecting section and the second connecting section; the second coupling section is perpendicularly connected between the first coupling section and the third radiating section.

8. The antenna structure of claim 7, wherein the resonating unit further comprises a resonating portion, the resonating portion is positioned on the first side surface and is perpendicularly connected to a junction of the second coupling section and the third radiating section.

9. A wireless communication device comprising:

a grounding plane;

a baseboard positioned on and electrically coupled to the grounding plane; and an antenna structure comprising:

a feed unit positioned on the baseboard;

a grounding unit positioned on the baseboard and spaced apart from the feed unit;

an antenna holder, the antenna holder comprising a bottom surface, a top surface, a first side surface, and a second side surface, wherein the top surface is positioned opposite to the bottom surface; the first side surface and the second side surface are parallel to each other and are perpendicularly connected between the bottom surface and the top surface;

a connecting unit electrically coupled to the feed unit and the grounding unit;

a radiating unit electrically connected to a first side of the connecting unit and configured to activate a first resonance mode;

a resonating unit electrically connected to a second side of the connecting unit and configured to activate a second resonance mode;

a first connecting section; and a second connecting section;

wherein the first connecting section and the second connecting section are positioned on the second side surface and the radiating unit is electrically connected to the connecting unit through the first connecting section and the second connecting section.

10. The wireless communication device of claim 9, further comprising a metallic portion, wherein the metallic portion is positioned surround and electrically connected to the grounding plane for forming a ground system with the grounding plane and the baseboard.

11. The wireless communication device of claim 9, wherein the connecting unit, the radiating unit, and the resonating unit are positioned on surfaces of the antenna holder via a means of laser direct structuring (LDS).

12. The wireless communication device of claim 9, wherein the connecting unit is positioned on the bottom surface, the radiating unit is positioned on the top surface and the second side surface, and the resonating unit is positioned on the bottom surface, the top surface, and the first side surface.

13. The wireless communication device of claim 9, wherein the radiating unit comprises a first radiating portion; the first radiating portion comprising a radiating sheet and an extending sheet, the radiating sheet is positioned on the top surface and is electrically connected to the first connecting section and the second connecting section; the extending sheet is positioned on the second side surface and is angled relative to the radiating sheet.

14. The wireless communication device of claim 13, wherein the radiating unit further comprises a second radiating portion, the second radiating portion is positioned on the top surface and is coupled to one end of the radiating sheet adjacent to the feed unit, and an opening is defined at one side of the second radiating portion away from the radiating sheet.

15. The wireless communication device of claim 14, wherein the radiating unit further comprises a third radiating portion, the third radiating portion is coplanar with the radiating sheet and comprises a first radiating section and a second radiating section, the first radiating section is substantially perpendicularly connected to one end of the radiating sheet away from the second radiating portion; the second radiating section is perpendicularly connected to one end of the first radiating section away from the radiating sheet and extends towards the second radiating portion.

16. The wireless communication device of claim 9, wherein the resonating unit comprises a coupling portion, the coupling portion is substantially U-shaped and comprises a first coupling section, a second coupling section, and a third section; the first coupling section is positioned on the bottom surface, the second coupling section is positioned on the first side surface, and the third radiating section is positioned on the top surface; the first coupling section is electrically connected to one end of the connecting unit away from the first connecting section and the second connecting section; the second coupling section is perpendicularly connected between the first coupling section and the third radiating section.

17. The wireless communication device of claim 16, wherein the resonating unit further comprises a resonating portion, the resonating portion is positioned on the first side surface and is perpendicularly connected to a junction of the second coupling section and the third radiating section.

* * * * *